US006952336B2

(12) United States Patent
Werner et al.

(10) Patent No.: US 6,952,336 B2
(45) Date of Patent: Oct. 4, 2005

(54) PROTECTIVE ELEMENT FOR THE DISSIPATION OF OVERVOLTAGES AND ITS USE

(75) Inventors: Frank Werner, Berlin (DE); Norbert Krost, Berlin (DE); Jürgen Boy, Berlin (DE)

(73) Assignee: EPCOS AG, Munich (DE)

( * ) Notice: Subject to any disclaimer, the term of this patent is extended or adjusted under 35 U.S.C. 154(b) by 240 days.

(21) Appl. No.: 10/623,332

(22) Filed: Jul. 18, 2003

(65) Prior Publication Data

US 2004/0066599 A1 Apr. 8, 2004

Related U.S. Application Data

(60) Provisional application No. 60/397,438, filed on Jul. 19, 2002.

(51) Int. Cl.[7] ..... H02H 1/00
(52) U.S. Cl. ..... 361/119; 361/127
(58) Field of Search ..... 361/111, 112, 361/117, 118, 119, 120, 127

(56) References Cited

U.S. PATENT DOCUMENTS 4,288,833 A * 9/1981 Howell ..... 361/124
4,396,970 A * 8/1983 Scudner, Jr. ..... 361/127
4,803,588 A * 2/1989 Bzdak ..... 361/118
5,383,085 A 1/1995 Boy et al. ..... 361/119
5,559,663 A * 9/1996 Tanaka et al. ..... 361/127

FOREIGN PATENT DOCUMENTS

| | | | |
|---|---|---|---|
| DE | 23 55 421 | 5/1975 | ..... H01T/5/04 |
| DE | 43 31 215 | 3/1994 | ..... H01T/4/10 |
| DE | 198 56 939 | 6/2000 | ..... H02H/9/06 |
| GB | 1 492 385 | 11/1977 | ..... H02H/9/04 |
| GB | 2 345 390 | 7/2000 | ..... H01T/1/16 |

OTHER PUBLICATIONS

*Patent Abstracts of Japan* for Japanese Publication No. 05283140 of Oct. 29, 1993.

* cited by examiner

*Primary Examiner*—Ronald Leja
(74) *Attorney, Agent, or Firm*—Schiff Hardin LLP

(57) ABSTRACT

A protective element safely dissipates overvoltages which is comprised of a parallel connection of a varistor and an surge arrester. To reduce the capacity of the protective element, the varistor is fashioned as a disc and arranged between a contact pins and the surge arrester. An electrical isolation between contact pin and varistor is ensured by an electrically isolated spacer, in which openings for electrical contact elements are provided to connect the varistor with the cup and the contact pin with the surge arrester. The surge arrester and the spacer are preferably fit positively into the cup.

14 Claims, 4 Drawing Sheets

PROTECTIVE ELEMENT FOR THE DISSIPATION OF OVERVOLTAGES AND ITS USE

CROSS REFERENCE TO RELATED APPLICATIONS

The present application claims the benefit of U.S. Provisional Application No. 60/397,438, filed Jul. 19, 2002.

BACKGROUND OF THE INVENTION

1. Field of the Invention

The invention relates to a protective element that safely dissipates overvoltages which is comprised of a parallel connection of a varistor and an surge arrester.

2. Description of the Related Art

A protective element to dissipate electrical overvoltages is, for example, known from German patent document DE 43 31 215 A1, which discloses such an element comprising a parallel circuit of an surge arrester, an air-spark gap, and a varistor that are arranged in cup-shaped metallic casing. The varistor is annularly fashioned and is directly attached to the surge arrester. A contact pin that is in contact with the upper electrode of the surge arrester is led through the annularly fashioned varistor. Lower electrodes of the surge arrester and upper electrodes of the varistor are connected to the cup-shaped casing.

Such a protective element made from a parallel-circuited varistor and surge arrester has the advantage that, given steeply climbing overvoltages, the spark delay of the surge arrester is bypassed with the aid of the previously indicated varistor. In this manner, the shielding effect of the protective element during the response time of the surge arrester is improved.

However, what is disadvantageous in the known protective element is that the annular varistor exhibits a high self-capacitance. This determines the damping behavior of the protective element when it is applied to high-frequency circuits. A higher capacity thereby leads to higher damping that in turn reduces the conductor lengths that can be realized with such a protective element.

However, in high-frequency telecommunication systems, such as ADSL, VDSL, and others, there is a need for protective elements to dissipate overvoltages that can bypass the reaction time of the surge arrester and simultaneously exhibit a low dampening; such devices are particularly appropriate for the high-frequency systems.

SUMMARY OF THE INVENTION

The object of the invention is therefore to specify such a protective element which avoids the cited disadvantages of known protective elements.

The object is inventively achieved with a protective element to dissipate overvoltages, comprising a surge arrester having a first electrode and a second electrode; a varistor that is fashioned as a disc and exhibits a lesser diameter than the surge arrester, the varistor having a lower electrode that sits directly upon the first electrode of the surge arrester, and an upper electrode; a contact pin that contacts the first electrode of the surge arrestor; an electrically isolated spacer that is arranged between the varistor and the contact pin; and an electrically conductive cup, in which the varistor and the surge arrester are electrically connected in parallel between the cup and the contact pin, the cup having base upon which sits the second electrode of the surge arrester, the cup having an electrical connection with the upper electrode of the varistor, wherein the contact pin is arranged at least partially in a space between the cup and the varistor. Various embodiments of the invention may comprise additional features, including a spreader element that comprises at least two arms connected with the upper electrode of the varistor, the spreader element being braced in the cup, and that serves as an electrical connection with the cup. The contact pin may comprise at least two feet that are directed laterally past the varistor. The spacer may be fitted to an inner diameter of the cup, and comprise openings separated from one another for feet of the contact pin. The contact pin may comprise at least two feet that are directed laterally past the varistor, wherein the spacer may be fitted to an inner diameter of the cup, and the spacer may comprise openings separated from one another for feet of the contact pin or for the feet of the contact pin and the arms of the spreader element. The spacer may comprise a depression in the middle in which the contact pin is partially embedded. The spacer may comprise a depression in the middle in which the varistor is partially embedded. The varistor, surge arrester, and cup may be fashioned rotationally symmetric, in that the contact pin, spacer, varistor, and surge arrester may be arranged coaxial and concentric to a central axis of the cup. The width of the cup in the region of the surge arrester may exhibit a steplike expansion, such that, in the region of the first electrode of the surge arrester, the cup is separated apart from it. The cup and the contact pin may be fashioned from brass, and the spacer may be fashioned from rubber or silicon. The element may be configured to have an operating voltage of the varistor such that it is above the operating voltage of the surge arrester. The inventive element may be utilized in a telecommunication device or a high-frequency telecommunication system component for protection.

DESCRIPTION OF THE DRAWINGS

The invention is more closely explained in the following using exemplary embodiments and the figures appertaining thereto. The figures show partially not-to-scale and schematic images of various exemplary embodiments of the invention.

DETAILED DESCRIPTION OF THE PREFERRED EMBODIMENTS

Figure 1:
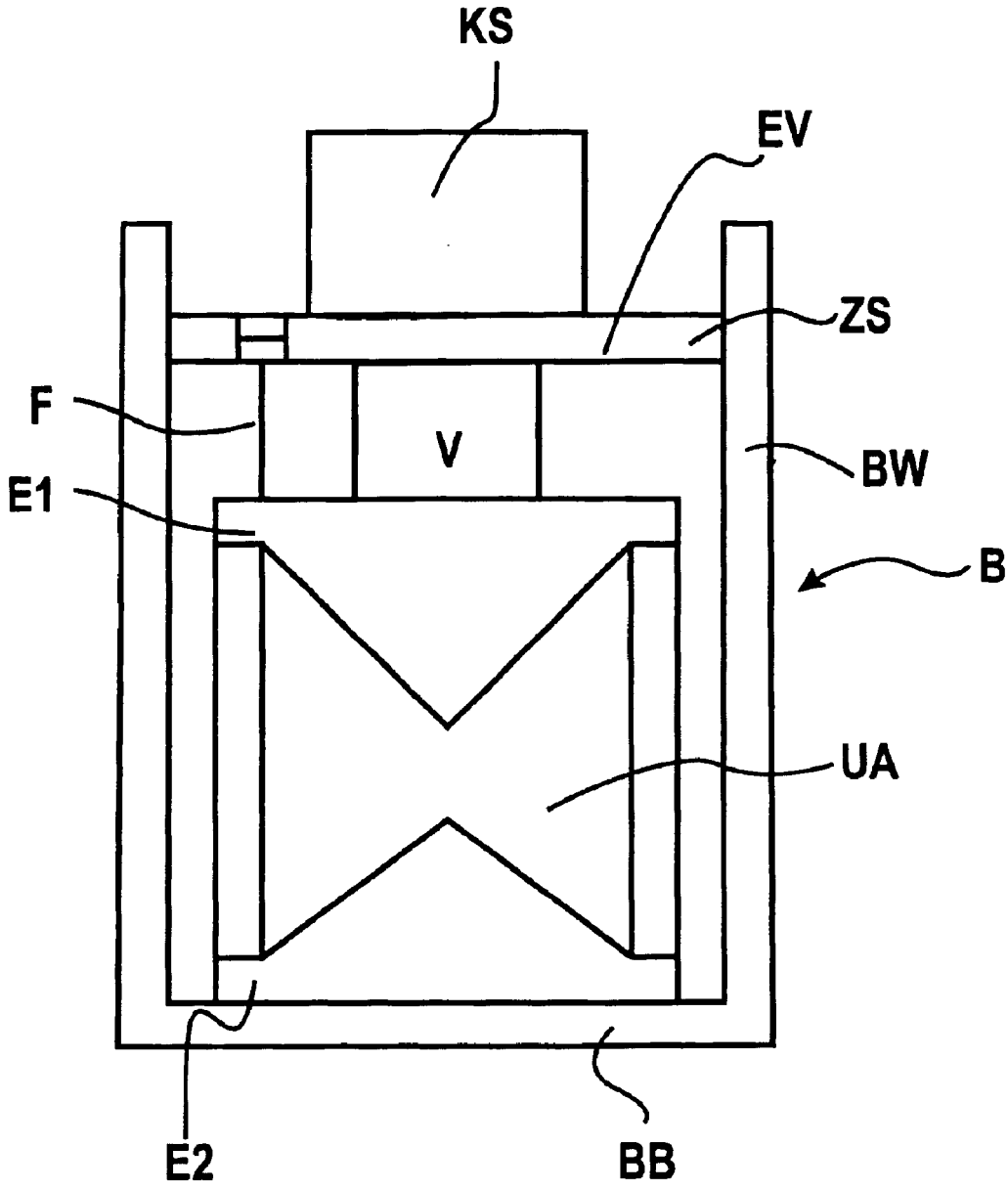
FIG. 1 shows an inventive protective element in schematic cross section.

In an embodiment of the protective element, a varistor and an surge arrester are arranged in an electrically conductive cup and electrically connected in parallel between the cup and a contact pin. The varistor is fashioned disc-shaped and directly contacts a first electrode of the surge arrester. The second electrode of the surge arrester sits at the bottom of the cup and electrically contacts it. The upper electrode of the varistor is connected in an electrically conductive fashion with the cup. The contact pin is connected in an electrically conductive manner with the first electrode of the surge arrester and is at least partially guided in the space between the varistor and the cup. An isolated spacer is arranged between the varistor and the contact pin.

The varistor and surge arrester are preferably fashioned in a rotationally symmetric fashion and arranged concentric to or coaxial to one another in the cup. The diameter of the cup is determined by the diameter of the surge arrester. The width of the cup in the region of the surge arrester preferably comprises a step-like expansion, such that the cup in the region of the upper electrode of the surge arrester is spaced apart from it.

The upper electrode of the varistor is preferably mechanically and electrically connected with a spreader element which comprises at least two arms that are braced against the opposite inner walls of the cup and connect in an electrically conductive fashion the upper electrodes of the varistor with the cup. This has the simultaneous advantage that both a centered arrangement of the varistor and a secure fastening of the varistor in the cup are achieved. Also advantageous is a spreader element with more than two arms that are equally offset from each other in a circular arc. An optimal bracing is thus achieved.

The contact pin preferably comprises at least two feet that are laterally guided in between the varistor and the inner wall of the cup to the first electrode of the surge arrester. These feet are then braced against the arms of the spreader element or are guided through between them.

The electrically isolated spacer is preferably fashioned in an elastic manner and comprises an implementation such that it can lie firmly against the inner wall of the cup in the manner of a rubber stopper. The spacer comprises openings through which the feet of the contact pin are guided. The arms of the spreader element are preferably cambered up on the walls of the cup, whereby openings in the spacer are also advantageously provided for the upward-cambered ends of the arms of the spreader element. The number of feet and the arms of the spreader element preferably correspond to one another and are then arranged by pairs or, respectively, alternating. In an advantageous embodiment, the spreader element comprises three arms and the contact pin comprises three feet.

In a further advantageous embodiment of the invention, the spacer comprises a disc-shaped base member, that comprises in the middle on at least one side a depression that is fit to the diameter of the contact pin and/or the varistor, whereby the contact pin and/or varistor are at least partially embedded into the depression of the spacer.

In an embodiment of the invention, the spacer forms the upper end of the cup, whereby the contact pin surmounts the cup wall and the spacer. The arms of the spreader element end underneath the upper cup wall and, in a preferred embodiment, can be completely covered by the upper region of the spacer.

The cup and the contact pin are preferably fashioned from brass.

The varistor is preferably fashioned as a known type of metal-oxide varistor.

The surge arrester can also be arbitrarily chosen, and is known in its exact embodiment. Gas-filled surge arresters are advantageously implemented that comprise an ignition mechanism and, given overvoltage, a gas discharge to a dissipating electrode can be formed.

Referring now to the figures, FIG. 1 shows a schematic cross section of the principle assembly of an embodiment of the inventive protective element. The protective element is arranged in a cup B which is comprised of an approximately cylindrical cup wall BW and a cup base BB. On top of one another inside the cup B are an surge arrester UA, a varistor V, a spacer ZS and furthermore a contact pin KS. The surge arrester UA sits upon the cup base BB and is electrically connected with it via its second electrode E2. The varistor V sits upon the surge arrester UA and is connected with the first electrode E1 of the surge arrester via its lower electrode. The spacer is arranged between the contact pin and the varistor such that it has positive fit, and electrically isolates them from one another. The upper electrode of the varistor is connected with the cup wall BW via an electrical connection EV. The contact pin KS is connected with the first electrode E1 of the surge arrester via a foot. In this manner, an electrical parallel circuit of the two shielding components of the protective element ensues between the contact pin KS and the cup B.

In a preferred use of the protective element, it is held via spring tension between the two contacts that are connected to the contact pin KS and the cup base BB. In this manner, an additional mechanical fixation of the individual parts of the protective element is not necessary. However, it is possible that individual parts of the protective element are inserted into the cup B such that they have positive fit, and in this manner are mechanically fixed to it. This allows the surge arrester (as the largest components of the protective element in terms of volume) to fit positively into the cup.

The spacer can likewise be of positive fit, in particular since it is preferably fashioned from an elastic material such as rubber or silicon/unvulcanized rubber. A further fixation can ensue via the electrical connection EV that, in an exemplary embodiment, is fashioned as a spreader element which comprises at least two arms that can brace against the inner cup wall BW. The foot F of the contact pin KS is, as shown, guided through the spacer ZS. However, it is also possible to fashion the electrically isolated spacer with a small diameter, whereby the feet are then guided past the spacer to the surge arrester UA.

Figure 2A:
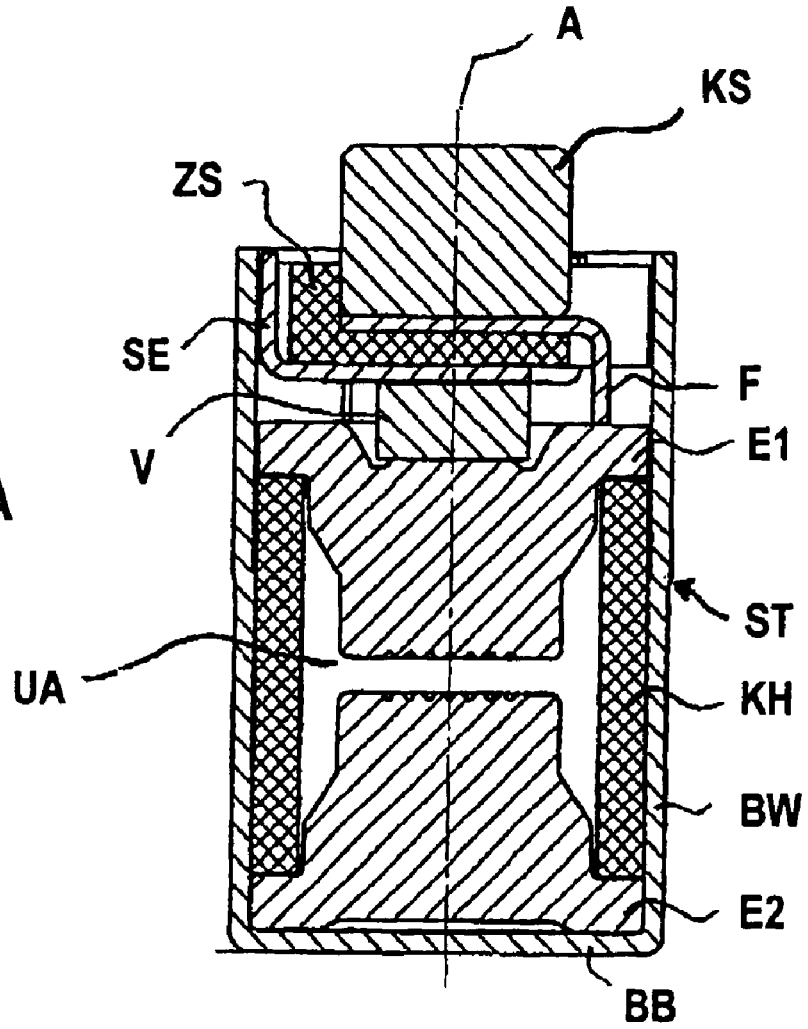
FIG. 2A shows a further embodiment of a protective element in schematic cross section.

FIG. 2A shows a specific exemplary embodiment of the invention which follows the principle shown in FIG. 1. Here the assembly of the surge arrester UA is implemented precisely. It is primarily comprised of a ceramic casing KH and two electrodes E1, E2 that form a spark gap inside the gas-filled cavity of the ceramic casing KH.

The varistor V sits upon the first electrode E1 and is arranged here in a depression of the first electrode E1. The height of the total protective element can thereby be reduced. The varistor may be arranged inside the depression as a mesa-shaped flattened bump, such that only a central region of the lower electrode of the varistor is in contact with the first electrode E1 of the surge arrester UA. This ensures that only the metallization of the varistor is contacted, and prevents undesired current paths over the casing of the disc-shaped varisto.

The upper electrode of the varistor V may be connected with a metallic expanding element SE, of which one of the arms present in triplicate is shown in section in the figure. These are comprised, for example, of metallic lines that camber upwards at the end and altogether can be positively-fit into the cup. An electrically isolated spacer may be arranged above the varistor V or above the protective element SE connected with it. This comprises in the region of the cup wall an end-to-end or blind-hole-shaped opening through which the cambered end of the protective element SE is guided and there lies against the cup wall BW. The contact pin KS may sit on the spacer ZS, comprising at least one foot F that may be directed downwards through a further opening of the spacer and may be electrically connected with the first electrode E1 of the surge arrester UA. The electrical connection can be implemented as a press contact.

The contact pin and the cup, as well as the feet and the spreader element, may be fashioned from brass. The electrical connection between the contact pin KS and its foot F may be preferably implemented as a solder connection, as can be the connection between the upper electrode of the varistor and the protective element SE. The electrical connection between the lower electrode of the varistor and the upper electrode E1 of the surge arrester is likewise electrically conductive, for example a solder connection, or implemented as an electrically conductive glued connection. However, it is also possible to implement this electrical connection as a press contact.

A further advantageous detail of the protective element shown in FIG. 2A is a stepped expansion ST of the width of the cup that leads to a larger internal diameter above the stepped expansion ST. This has the result that an air gap forms between the outer border area of the first electrode E1 of the surge arrester UA and the cup wall, that on the one hand electrically isolates this electrode E1 from the cup wall BW, and on the other hand provides an additional air-spark gap. This enables a second current path that effects a safe dissipation of this overvoltage by way of a spark discharge/[arc-over to the cup wall In the unlikely event of a total failure of the surge arrester (for example, given a leak).

Figure 2B:
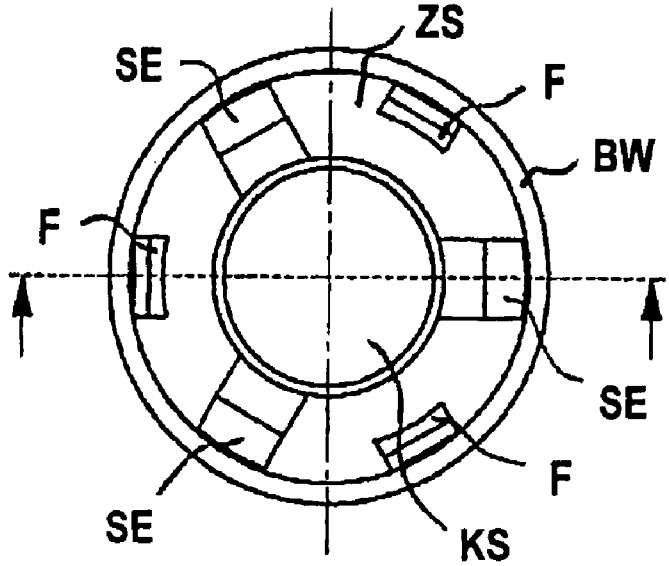
FIG. 2B shows the embodiment shown in FIG. 2A in top view.

FIG. 2B shows the component from FIG. 2A in top-view. It is made clear in the top-view that the protective element is preferably fashioned rotationally symmetric with a central axis of symmetry, that here exhibits a triagonal symmetry. This symmetry in particular affects the number and arrangement of the arms of the spreader element as well or the feet F of the contact pin KS. It is also made clear from the top-view that the arms of the spreader element, as well as the feet, are displaced alternating opposite one another, and are guided through openings of the spacer ZA spaced apart opposite one another. The spacer ZS preferably terminates with the inner cup wall BW with positive fit between the openings. The contact pin KS is preferably inserted into a depression of the spacer, which thus internally exhibits a smaller thickness than between the openings.

Figure 3:
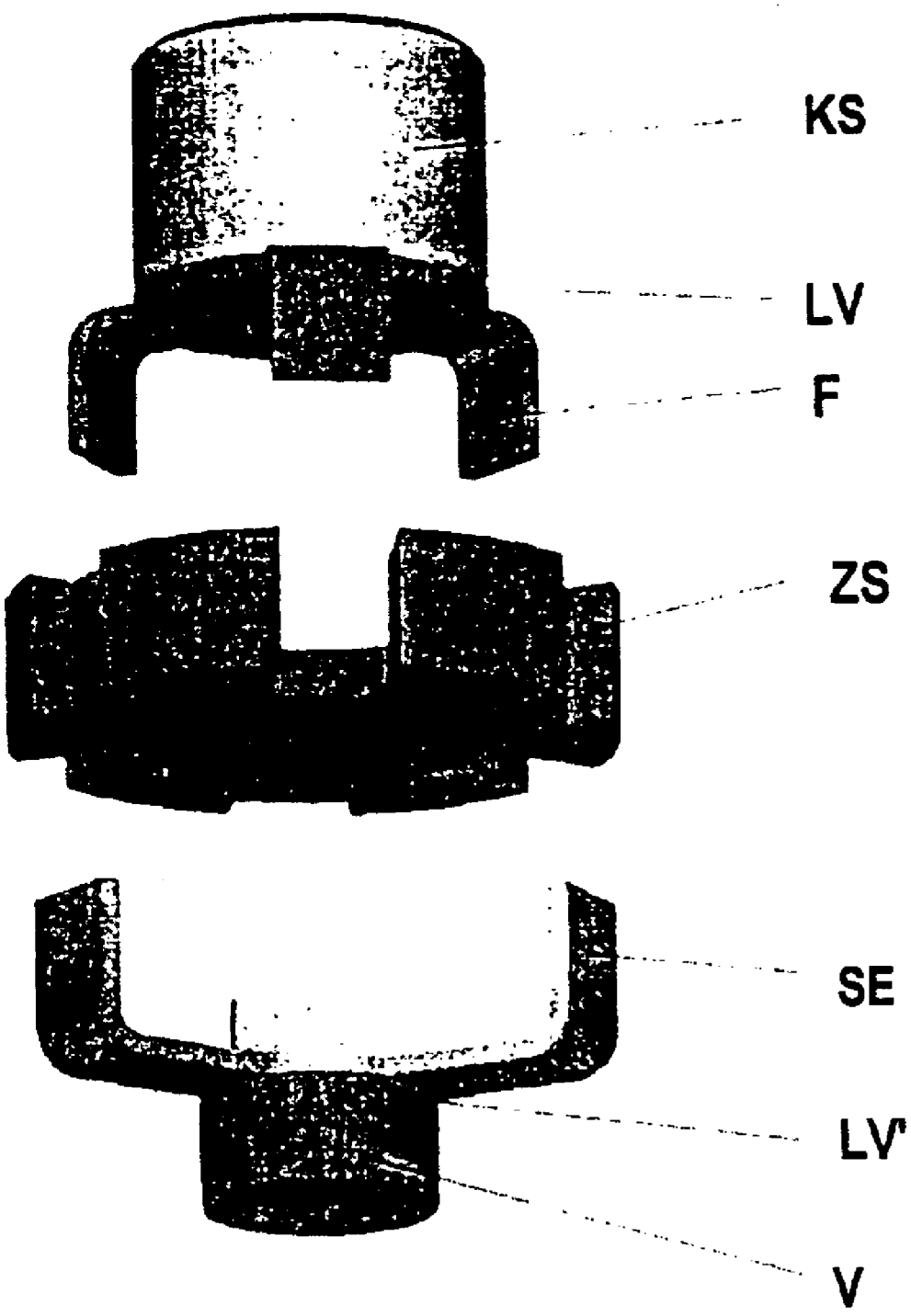
FIG. 3 shows individual parts of an inventive component in a perspective exploded view.

FIG. 3 shows a perspective exploded view of a contact pin KS with feet F, a spacer ZS, and a varistor V connected with a spreader element SE. It is made clear from the figure that the varistor and the spreader element form a connected unit, preferably by a solder connection LV', just like the contact pin KS and the feet connected to it by a solder connection LV.

The disc-shaped spacer, fashioned here in terms of its basic shape, comprises openings in its border area through which the feet F or the arms of the spreader element SE can be pushed from various sides.

Figure 4:
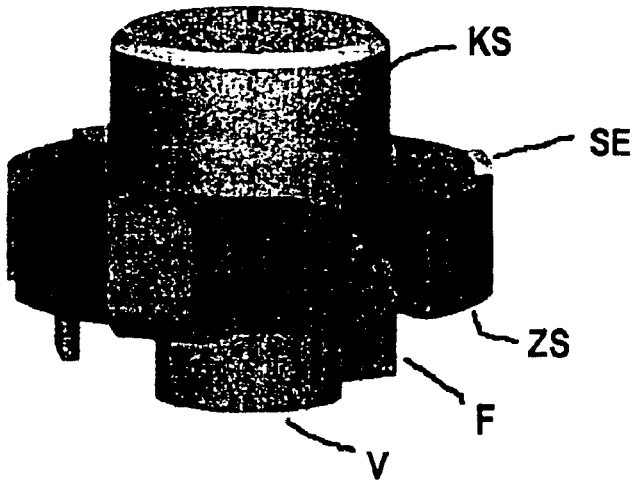
FIG. 4 shows the parts of FIG. 3 in assembled form.
Figure 5:
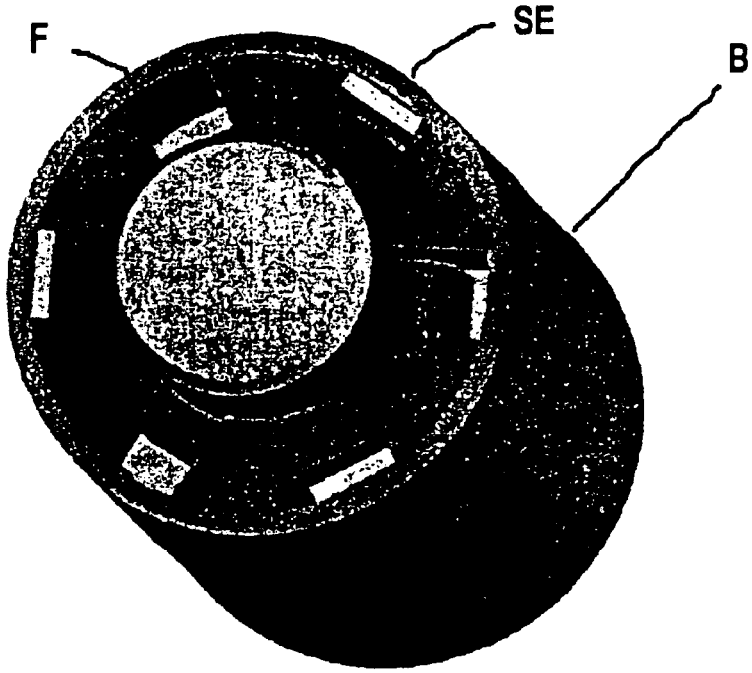
FIG. 5 shows the exemplary embodiment from FIG. 4 inside a cup.

FIG. 4 likewise shows in perspective depiction the three components shown in FIG. 3 in assembled form, as they are also arranged in the finished protective element. It is made clear from this image that the spacer ZS serves for electrical isolation between the contact pin and the varistor or for electrical isolation of the feet F from the arms of the spreader element SE. The feet F are likewise separated from the varistor, as the arms of the spreader element SE are from the contact pin.

In a perspective top-view, FIG. 3 shows how the part shown in FIG. 4 fits positively into the cup B. It is made clear from the figure that the spacer ZS locks with the cup B with positive fit. It is likewise clear that the arms of the spreader element SE are spread against the cup wall and, in this manner, produce an electrical contact with it.

Although the invention was only explained using an exemplary embodiment, it is nevertheless not limited to it. Since it primarily shows an arrangement and circuitry of a varistor and a contact pin by way of an electrically isolated spacer, feet, and expanding element, the exact implementation of the protective element UA as well as of the varistor V is of no importance to the invention. What is relevant is only that the varistor is disc-shaped, whereby upper and lower primary surfaces are metallized and thus form upper and lower electrodes. Such a varistor has a lower capacity and allows the use of the protective element in high-frequency systems, in particular for high-frequency communication systems such as ADSL, VDSL, etc. The invention is marked by the lesser required space, the simple construction, and the reliable cohesion due to the special geometric design. Further possible variations of the invention arise from the selection of different protective element types, different materials for the individual components, as well as a geometric implementation differing from the shown spatial design.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art. For the sake of brevity, conventional electronics and other functional aspects. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

REFERENCE CHARACTERS

A axis of symmetry
B cup
BB cup base
BW cup wall
E1, E2 first and second electrode of the surge arrester
EV electrical connection of the upper electrode of the varistor with the cup
F feet of the contact pin
KH ceramic casing
KS contact pin
LV, LV' solder connection
SE spreader element
ST step-like expansion of the cup wall
UA surge arrester
V varistor
ZS electrically isolated spacer

What is claimed is:

1. A protective element to dissipate overvoltages, comprising:

a surge arrester having a first electrode and a second electrode;

a varistor that is fashioned as a disc and exhibits a lesser diameter than the surge arrester, the varistor having a lower electrode that sits directly upon the first electrode of the surge arrester, and an upper electrode;

a contact pin that contacts the first electrode of the surge arrestor;

an electrically isolated spacer that is arranged between the varistor and the contact pin; and an electrically conductive cup, in which the varistor and the surge arrester are electrically connected in parallel between the cup and the contact pin, the cup having base upon which sits the second electrode of the surge arrester, the cup having an electrical connection with the upper electrode of the varistor, wherein the contact pin is arranged at least partially in a space between the cup and the varistor.

2. The element according to claim 1, further comprising:

a spreader element that comprises at least two arms connected with the upper electrode of the varistor, the spreader element being braced in the cup, and that serves as an electrical connection with the cup.

3. The element according to claim 1, wherein the contact pin comprises at least two feet that are directed laterally past the varistor.

4. The element according to claim 3, wherein the spacer is fitted to an inner diameter of the cup, and comprises openings separated from one another for feet of the contact pin.

5. The element according to claim 2, wherein the contact pin comprises at least two feet that are directed laterally past the varistor wherein the spacer is fitted to an inner diameter of the cup, and the spacer comprises openings separated from one another for feet of the contact pin or for the feet of the contact pin and the arms of the spreader element.

6. The element according to claim 1, wherein the spacer comprises a depression in the middle in which the contact pin is partially embedded.

7. The element according to claim 1, wherein the spacer comprises a depression in the middle in which the varistor is partially embedded.

8. The element according to claim 1, wherein the varistor, surge arrester, and cup are fashioned rotationally symmetric, in that the contact pin, spacer, varistor, and surge arrester are arranged coaxial and concentric to a central axis of the cup.

9. The element according to claim 1, wherein the width of the cup in the region of the surge arrester exhibits a step-like expansion, such that, in the region of the first electrode of the surge arrester, the cup is separated apart from it.

10. The element according to claim 1, wherein the cup and the contact pin are fashioned from brass.

11. The element according to claim 1, wherein the spacer is fashioned from rubber or silicon.

12. The element according to claim 1, wherein the element is configured to have an operating voltage of the varistor such that it is above the operating voltage of the surge arrester.

13. A telecommunication device using the element according to claim 1 for protection.

14. A high-frequency telecommunication system component using the element according to claim 1 for protection.

* * * * *